US008630553B2

(12) United States Patent
Eto

(10) Patent No.: US 8,630,553 B2
(45) Date of Patent: Jan. 14, 2014

(54) IMAGE FORMING APPARATUS

(75) Inventor: Daisuke Eto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 257 days.

(21) Appl. No.: 13/117,552

(22) Filed: May 27, 2011

(65) Prior Publication Data

US 2011/0293294 A1 Dec. 1, 2011

(30) Foreign Application Priority Data

May 31, 2010 (JP) ..... 2010-125352

(51) Int. Cl.
*G03G 15/00* (2006.01)

(52) U.S. Cl.
USPC ..... 399/12

(58) Field of Classification Search
USPC ..... 399/9, 12, 13, 110, 111, 119, 120, 258, 399/260, 262
See application file for complete search history.

(56) References Cited

U.S. PATENT DOCUMENTS

| | | | | |
|---|---|---|---|---|
| 7,792,438 | B2 * | 9/2010 | Sato | 399/12 |
| 2007/0189781 | A1 * | 8/2007 | Katogi et al. | 399/12 |
| 2008/0166138 | A1 | 7/2008 | Hanano et al. | |

FOREIGN PATENT DOCUMENTS

| | | |
|---|---|---|
| JP | 09-134075 | 5/1997 |
| JP | 2009-116306 | 5/2009 |

* cited by examiner

*Primary Examiner* — Hoan Tran
(74) *Attorney, Agent, or Firm* — Dilworth & Barrese, LLP.

(57) ABSTRACT

The present invention provides a detection unit that detects, regarding a toner supply device loaded into an installation space of an apparatus main body, a type of the toner supply device or detects improper loading of the toner supply device and a notification unit that notifies loading of the toner supply device of a wrong type or improper loading of the toner supply device based on a result of detection by the detection unit.

5 Claims, 16 Drawing Sheets

IMAGE FORMING APPARATUS

This application is based on and claims the benefit of priority from Japanese Patent Application No. 2010-125352, filed on 31 May 2010, the content of which is incorporated herein by reference.

BACKGROUND OF THE INVENTION

1. Field of the Invention

The present invention relates to an image forming apparatus provided with a detachable toner supply device that supplies a toner to an image forming unit.

2. Related Art

An image forming apparatus such as a copy machine, a printer, a facsimile machine, and a multi-functional printer having functions thereof are generally provided with an image forming unit that forms a toner image to be transferred to printing paper. To the image forming unit, a toner is supplied from a toner supply device (toner cartridge).

The toner supply device is configured for each model of the image forming apparatus. A compliant toner supply device for the model of the image forming apparatus is loaded into an installation space in an apparatus main body and supplies a toner to the image forming unit. Therefore, loading of a noncompliant toner supply device to the installation space in the apparatus main body and improper loading of a compliant toner supply device to the installation space (the toner supply device not fully inserted to an loading position) must be avoided.

As a technology for avoiding loading of a noncompliant toner supply device, a technology of forming a joint portion to be inserted into a developer container on a toner supply device of one model and forming a joint portion of a different shape on a toner supply device of another model has been known. In this technology, when a noncompliant toner supply device is loaded into an image forming apparatus, the joint portion thereof cannot be inserted into the developer container. Improper loading of the toner supply device can thus be avoided.

However, in this technology, when a toner supply device is loaded into an image forming apparatus, properness of the toner supply device is determined by physical interference upon insertion of the joint portion into the developer container. It is therefore difficult for an engineer to recognize a noncompliant toner supply device being loaded into the installation space. In addition, if a cover door body is closed in a state in which the noncompliant toner supply device is loaded into the installation space, an unexpected force is applied to the toner supply device and the toner supply device may break. And then, once the cover door body is closed, the engineer cannot recognize that the noncompliant toner supply device is being loaded into the installation space.

SUMMARY OF THE INVENTION

A problem to be solved by the present invention is to provide an image forming apparatus that allows an engineer to easily recognize improper loading of the toner supply device by detecting and notifying loading of a noncompliant toner supply device or improper loading of a compliant toner supply device.

Another problem to be solved by the present invention is to provide an image forming apparatus that allows loading of a noncompliant toner supply device to the installation space and detects and notifies loading of the noncompliant toner supply device after loading, thereby avoiding an unexpected force applied by the cover door body.

The present invention relates to an image forming apparatus including: at least one image forming unit that is disposed in an apparatus main body and forms a toner image; and at least one toner supply device that is loadable and unloadable with respect to an installation space in the apparatus main body and supplies a toner to the image forming unit, in which the toner supply device includes a toner supply opening that is communicatively connected to the image forming unit and an open/close member that opens and closes the toner supply opening, in which the image forming apparatus further comprises: a detection unit that detects, regarding the toner supply device loaded into the installation space, a type of the toner supply device or detects improper loading of the toner supply device; and a notification unit that notifies loading of the toner supply device of a wrong type or improper loading of the toner supply device based on a result of detection by the detection unit.

According to the present invention, a detection unit can detect a type of the toner supply device (compliant or noncompliant) loaded into the installation space or an improper loading of the toner supply device, regardless of recognition by the engineer who loads the toner supply device. By notifying loading of a noncompliant toner supply device or improper loading of a compliant toner supply device based on a result of detection by the detection unit, an engineer can easily recognize improper loading of the toner supply device.

DETAILED DESCRIPTION OF THE INVENTION

An image forming apparatus of the present invention is described hereinafter with reference to FIGS. 1 to 29.

Overall Structure of Image Forming Apparatus

An overall structure of the image forming apparatus is described with reference to FIG. 1.

Figure 1:
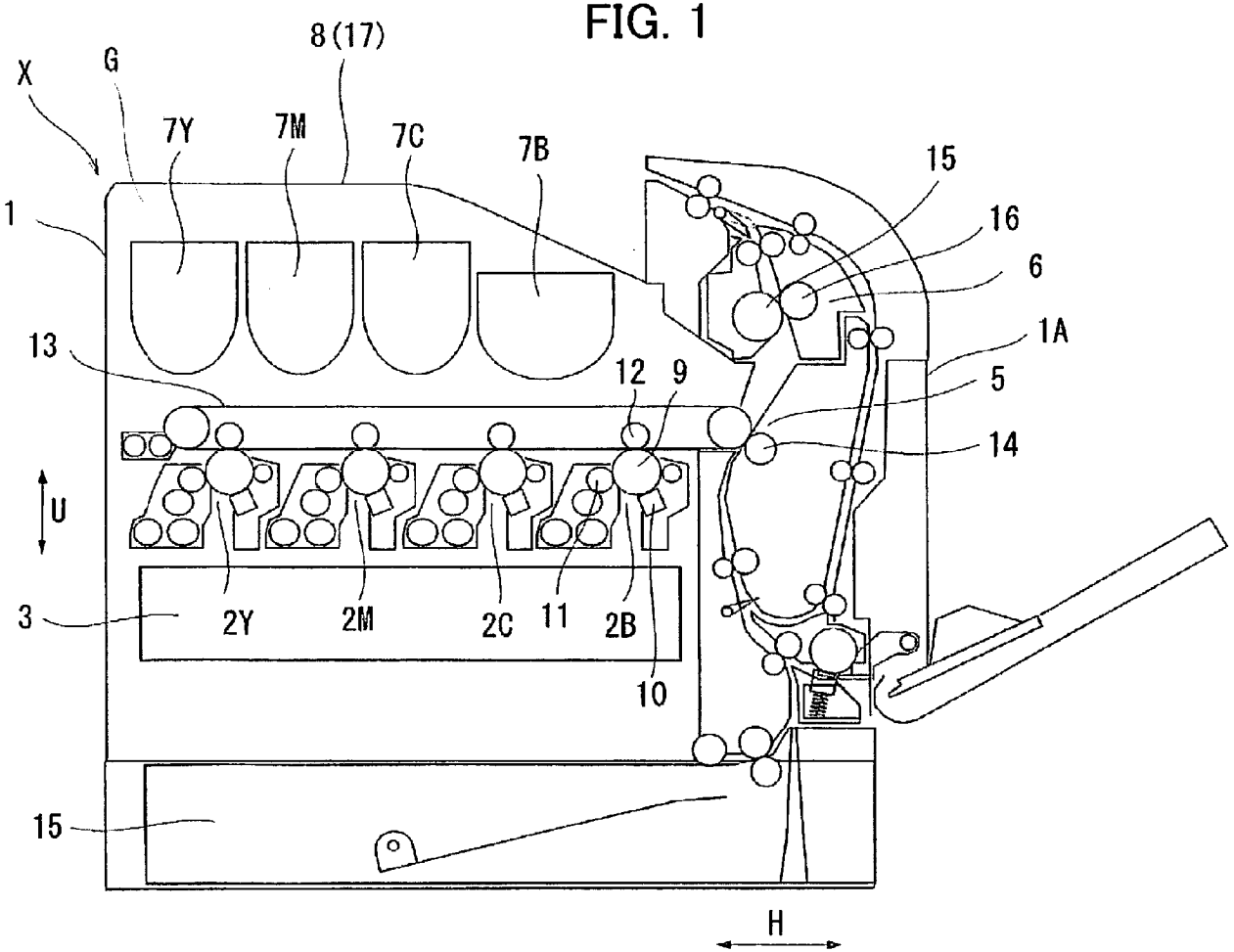
FIG. 1 is a cross-sectional view of an image forming apparatus according to the present invention.

FIG. 1 is a cross-sectional view of the image forming apparatus according to the present invention.

In FIG. 1, the image forming apparatus X is configured to include: an apparatus main body 1; a plurality of image forming units 2M, 2C, 2Y and 2B; an exposure unit 3; a secondary transfer unit 5; a fixing unit 6; and a plurality of toner supply devices 7M, 7C, 7Y and 7B.

As shown in FIG. 1, the apparatus main body 1 has an installation space G with an opening in an upper end thereof in a vertical direction U. The opening of the installation space G is openable and closable by a cover door body 8. The cover door body 8 is provided in the apparatus main body 1 and rotatably pivotally supported on a first end 1A side, which is one end in a width direction H of the apparatus main body 1.

As shown in FIG. 1, the plurality of image forming units 2M, 2C, 2Y and 2B is disposed below the installation space G in the vertical direction U of the apparatus main body 1. Each of the image forming unit 2M, 2C, 2Y and 2B forms a toner image of magenta, cyan, yellow and black, respectively, and disposed in parallel in the width direction H of the apparatus main body 1.

As shown in FIG. 1, each of the image forming unit 2M, 2C, 2Y and 2B is provided with a photoreceptor drum 9, a charging device 10, a developing roller 11 and the like.

The photoreceptor drums 9 of the image forming unit 2M, 2C, 2Y and 2B are charged at a negative potential by a charging bias of the charging device 10. In addition, on the photoreceptor drums 9, electrostatic latent images of magenta, cyan, yellow and black are respectively formed by laser scanning by the exposure unit 3. As shown in FIG. 1, the exposure units 3 are disposed below the image forming units 2M, 2C, 2Y and 2B, respectively.

The developing rollers 11 of the image forming units 2M, 2C, 2Y and 2B deposit toners of magenta, cyan, yellow and black, respectively, on the electrostatic latent images formed on the photoreceptor drums 9 by a developing bias. The image forming units 2M, 2C, 2Y and 2B thus form a magenta toner image, a cyan toner image, a yellow toner image and a black toner image, respectively, on the electrostatic latent images on the photoreceptor drums 9.

The image forming units 2M, 2C, 2Y and 2B then primarily transfer the toner images on the photoreceptor drums 9 to an intermediate transfer belt 13 by a transfer bias of the primary transfer roller 12.

As shown in FIG. 1, the secondary transfer unit 5 is disposed on the first end 1A side, which is one end of the apparatus main body 1. The secondary transfer unit 5 is provided with the intermediate transfer belt 13 and a secondary transfer roller 14.

In the secondary transfer unit 5, printing paper fed from a paper feeding cassette 15 is nipped by the intermediate transfer belt 13 and the secondary transfer roller 14, as shown in FIG. 1. And then, the secondary transfer unit 5 transfers the toner images (the magenta, cyan, yellow and black toner images), which have been primarily transferred to the intermediate transfer belt 13, to the printing paper by a secondary transfer bias of the secondary transfer roller 14.

The fixing unit 6 is disposed above the secondary transfer unit 5 in the vertical direction U, as shown in FIG. 1. The fixing unit 6 is provided with a heating roller 15 and a pressurizing roller 16.

In the fixing unit 6, the printing paper fed from the secondary transfer unit 5 is nipped by the heating roller 15 and the pressurizing roller 16. The fixing unit 6 then heats and pressurizes the printing paper.

The fixing unit 6 thus fixes the toner images (the magenta, cyan, yellow and black toner images), which have been secondarily transferred to the printing paper.

The printing paper onto which the toner images are fixed is ejected to an ejection tray 17 disposed outside the apparatus main body 1, as shown in FIG. 1. The ejection tray 17 is composed of the cover door body 8, as shown in FIG. 1. The ejection tray 17 doubles as the cover door body 8.

The plurality of toner supply devices 7M, 7C, 7Y and 7B are loaded into the installation space G, as shown in FIG. 1. The toner supply devices 7M, 7C, 7Y and 7B are disposed in parallel in the width direction H, and communicatively connected to the image forming units 2M, 2C, 2Y and 2B respectively.

In addition, the toner supply devices 7M, 7C, 7Y and 7B store toners of magenta, cyan, yellow and black, respectively, and supply the toners to the image forming units 2M, 2C, 2Y and 2B, respectively.

Specific Structure of Toner Supply Device

Next, a specific structure of the toner supply device is described with reference to FIGS. 2 to 10.

Specific structures of a compliant toner supply device to be loaded into the image forming apparatus X and a noncompliant toner supply device to be loaded into an image forming apparatus of a different model are described.

1. Specific Structure of Compliant Toner Supply Devices 7M, 7C, 7Y, 7B A specific structure of the compliant toner supply devices 7M, 7C, 7Y and 7B is described hereinafter with reference to FIGS. 2 to 9.

Figure 2:
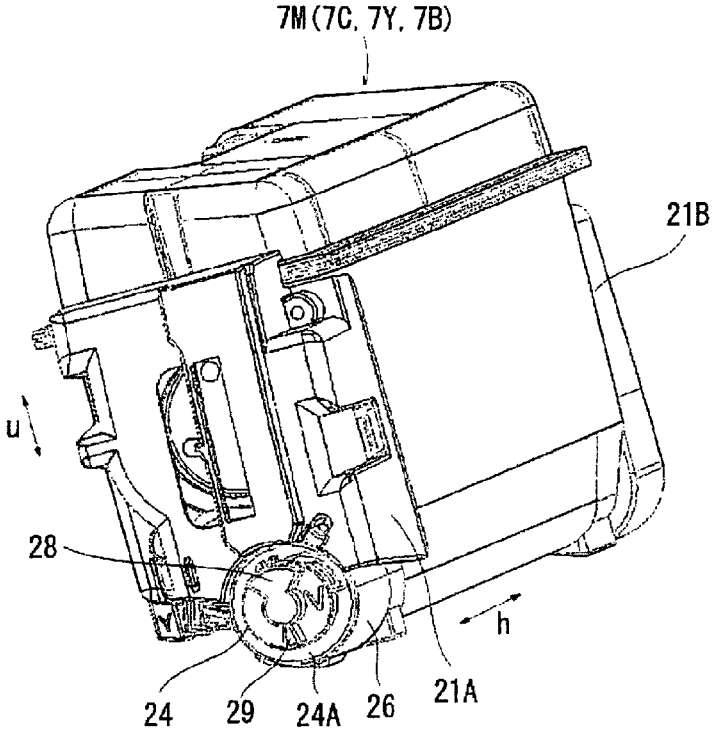
FIG. 2 is a perspective view showing a compliant toner supply device with a toner supply opening being in a closed state.
Figure 3:
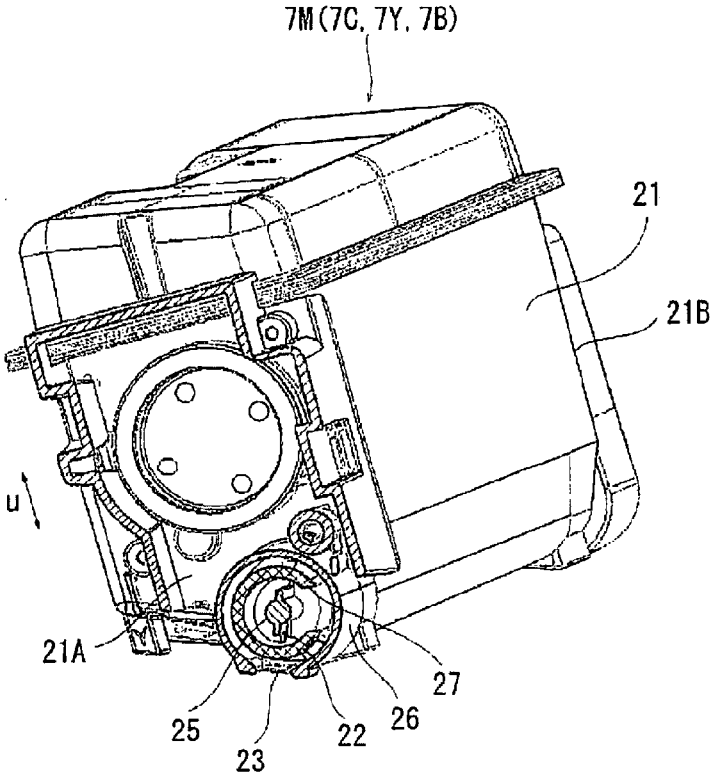
FIG. 3 is a cross-sectional perspective view showing the compliant toner supply device with the toner supply opening being in the closed state.
Figure 4:
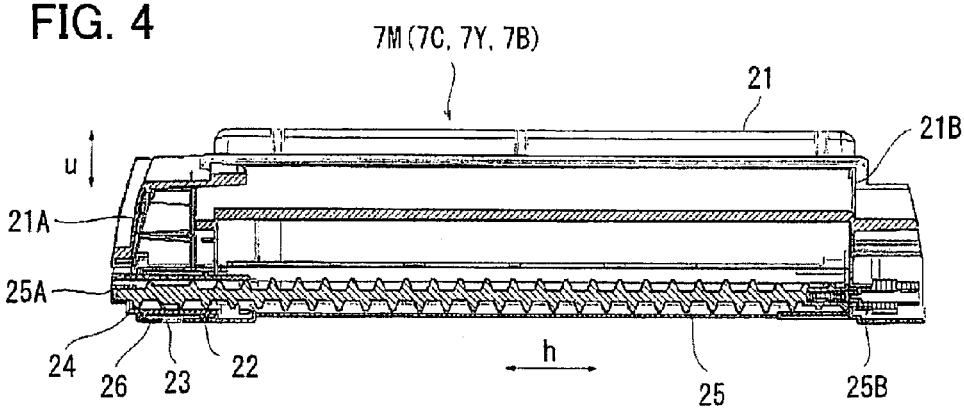
FIG. 4 is a cross-sectional view showing the compliant toner supply device with the toner supply opening being in the closed state.
Figure 5:
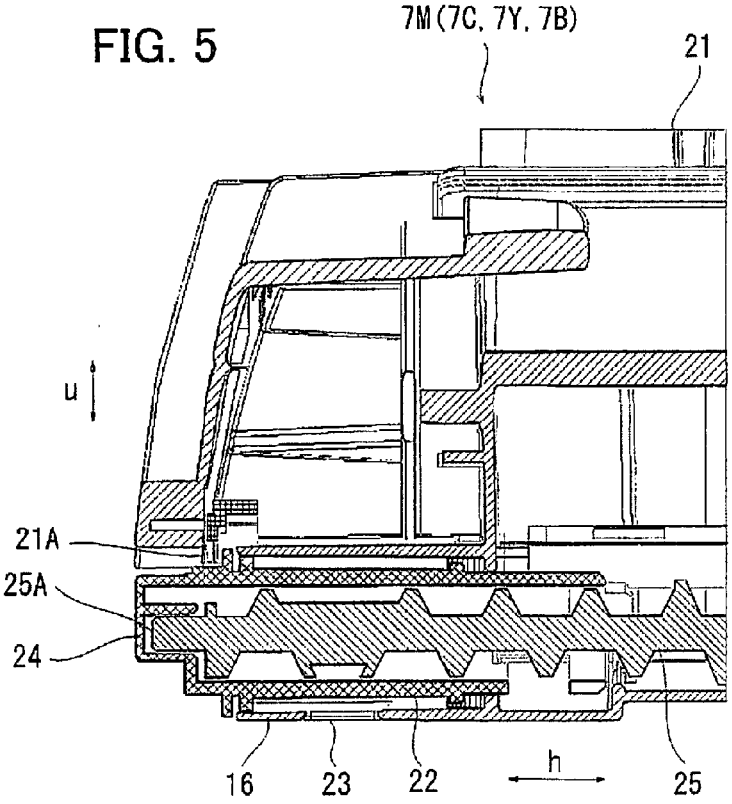
FIG. 5 is a cross-sectional enlarged view of FIG. 4.
Figure 6:
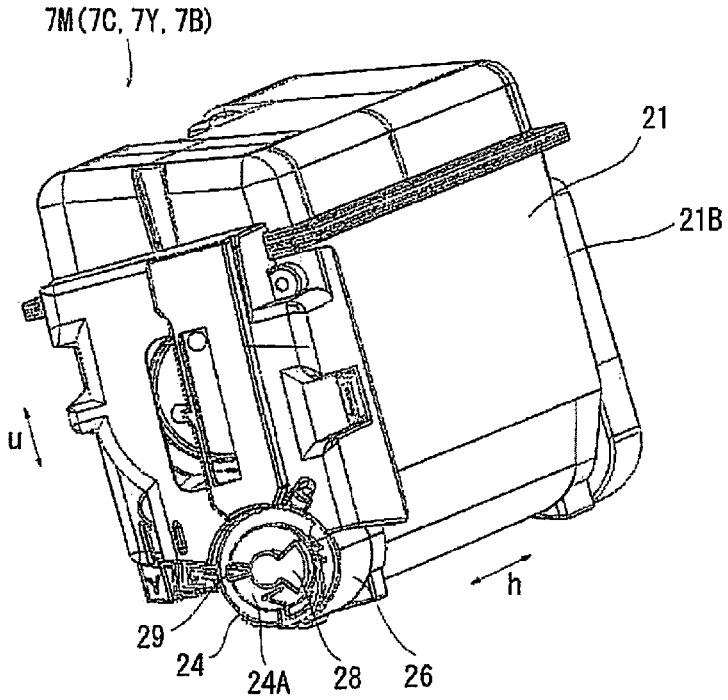
FIG. 6 is a perspective view showing the compliant toner supply device with the toner supply opening being in an opened state.
Figure 7:
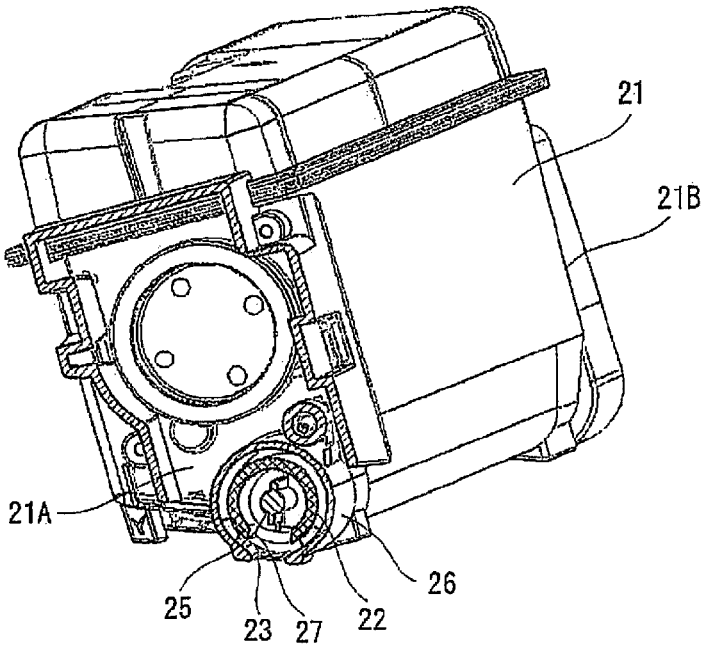
FIG. 7 is a cross-sectional perspective view showing the compliant toner supply device with the toner supply opening being in the opened state.
Figure 8:
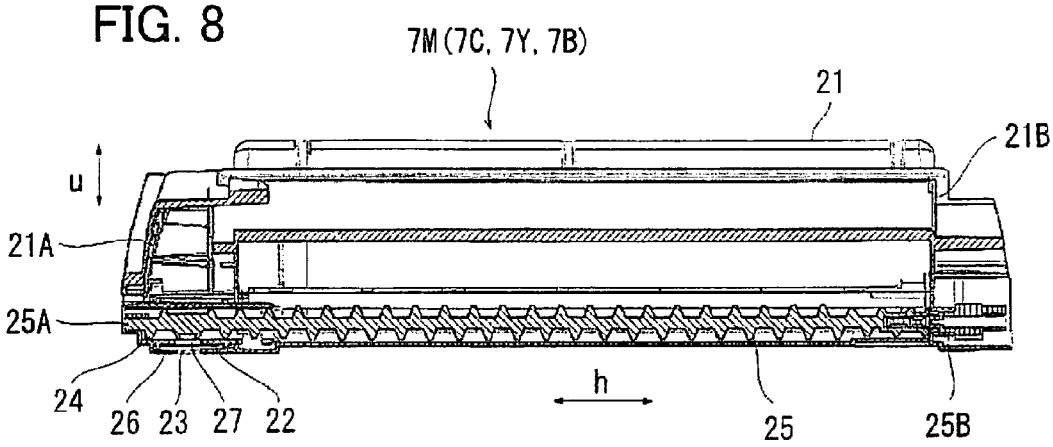
FIG. 8 is a cross-sectional view showing the compliant toner supply device with the toner supply opening being in the opened state.
Figure 9:
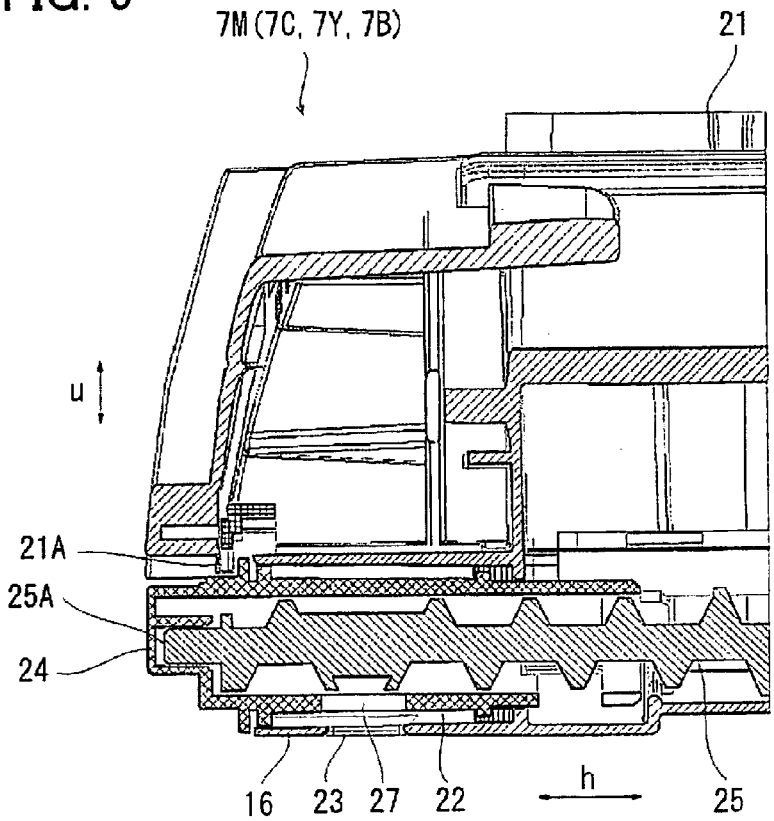
FIG. 9 is a cross-sectional enlarged view of FIG. 8.

FIG. 2 is a perspective view showing a compliant toner supply device with a toner supply opening being in a closed state. FIG. 3 is a cross-sectional perspective view showing the compliant toner supply device with the toner supply opening being in the closed state. FIG. 4 is a cross-sectional view showing the compliant toner supply device with the toner supply opening being in the closed state. FIG. 5 is a cross-sectional enlarged view of FIG. 4. FIG. 6 is a perspective view showing the compliant toner supply device with the toner supply opening being in an opened state. FIG. 7 is a cross-sectional perspective view showing the compliant toner supply device with the toner supply opening being in the opened state. FIG. 8 is a cross-sectional view showing the compliant toner supply device with the toner supply opening being in the opened state. FIG. 9 is a cross-sectional enlarged view of FIG. 8.

The compliant toner supply device 7M is a toner cartridge that stores a magenta toner, as shown in FIGS. 2 to 5.

The compliant toner supply device 7M is provided with a cartridge container 21, an open/close member 22, a toner supply opening 23, and an open/close coupling joint 24 (a compliant open/close joint).

The cartridge container 21 stores a magenta toner, as shown in FIGS. 4 and 5. Inside the cartridge container 21, a screw conveyor 25 that feeds the magenta toner to the toner supply opening 23 is disposed. The screw conveyor 25 is positioned below the cartridge container 21 in the vertical direction u. The screw conveyor 25 extends across the width of the cartridge container 21 in the width direction h.

In addition, in the cartridge container 21, a cylindrical storage body 26 that projects from the first end 21A in the width direction h is formed, as shown in FIGS. 2 and 3. The cylindrical storage body 26 has an opening toward the inside of the cartridge container 21.

The open/close member 22 is formed in a cylindrical shape, as shown in FIGS. 3 to 5. The open/close member 22 is rotatably disposed from the inside of the cylindrical storage body 26 to the inside of the cartridge container 21. In the open/close member 22, a toner ejection opening 27 is opened to connect the inside to the outside of the cylindrical shape, as shown in FIGS. 3, 8 and 9. The toner ejection opening 27 extends in the width direction h, as shown in FIGS. 8 and 9.

As shown in FIGS. 4 and 5, a first end 25A of the screw conveyor 25 is disposed inside the open/close member 22.

The toner supply opening 23 is formed on the cylindrical storage body 26, as shown in FIGS. 3 to 5. The toner supply opening 23 is disposed so as to be connectable to the toner ejection opening 27 of the open/close member 22, as shown in FIGS. 8 and 9.

The compliant open/close coupling joint 24 is formed in a cylindrical shape with a first end closed, as shown in FIGS. 2, 4 and 5. The open/close coupling joint 24 is formed integrally with the open/close member 22. The open/close coupling joint 24 projects from the first end 21A of the cartridge container 21. In addition, the open/close coupling joint 24 blocks a first end of the open/close member 22, as shown in FIG. 2.

The compliant open/close coupling joint 24 has a plurality of fan-shaped connecting parts 28, 29, as shown in FIG. 2. The fan-shaped connecting parts 28, 29 are formed integrally with a closed end 24A of the open/close coupling joint 24 so as to project from the closed end 24A. In addition, the fan-shaped connecting parts 28, 29 are disposed at an interval of 180 degrees along a circumference of the open/close coupling joint 24, as shown in FIG. 2.

The fan-shaped connecting part 28 is positioned upward in the vertical direction u, as shown in FIG. 2. The fan-shaped connecting part 29 is positioned downward in the vertical direction u. A width of the fan-shaped connecting part 28 is larger than a width of the fan-shaped connecting part 29 (fan-shaped connecting part 28>fan-shaped connecting part 29).

The open/close coupling joint 24 rotatably pivotally supports the first end 25A of the screw conveyor 25, as shown in FIGS. 4 and 5. A second end 25B of the screw conveyor 25 is rotatably pivotally supported on a side of a second end 21B of the cartridge container 21, as shown in FIG. 4.

In the compliant toner supply device 7M thus configured, the toner supply opening 23 can be switched from a closed state shown in FIGS. 2 to 5 to an opened state shown in FIGS. 6 to 9, by rotating the open/close coupling joint 24 and the open/close member 22 in a clockwise direction. When the toner supply opening 23 is in the closed state, the toner supply opening 23 is closed with the open/close member 22 as shown in FIGS. 3 to 5. When the toner supply opening 23 is in the opened state, the toner supply opening 23 is opened in such a way that the toner ejection opening 27 of the open/close member 22 faces the toner supply opening 23, as shown in FIGS. 6 to 9.

The compliant toner supply device 7M thus supplies the magenta toner fed by the screw conveyor 25 from the toner supply opening 23 through the toner ejection opening 27, as shown in FIGS. 6 to 9.

In addition, in the compliant toner supply device 7M, the toner supply opening 23 is switched from the opened state to the closed state by rotating the open/close coupling joint 24 and the open/close member 22 in a counterclockwise direction, as shown in FIG. 6.

The compliant toner supply devices 7C, 7Y and 7B of cyan, yellow and black have the same structure as the magenta toner supply device 7M shown in FIGS. 2 to 9, and therefore a detailed description thereof is omitted. In the toner supply devices 7C, 7Y and 7B, toners of cyan, yellow and black are stored in the cartridge containers 21, as shown in FIG. 2.

2. Specific Structure of Noncompliant Toner Supply Device 107

Next, a specific structure of the noncompliant toner supply device 107 is described with reference to FIG. 10.

Figure 10:
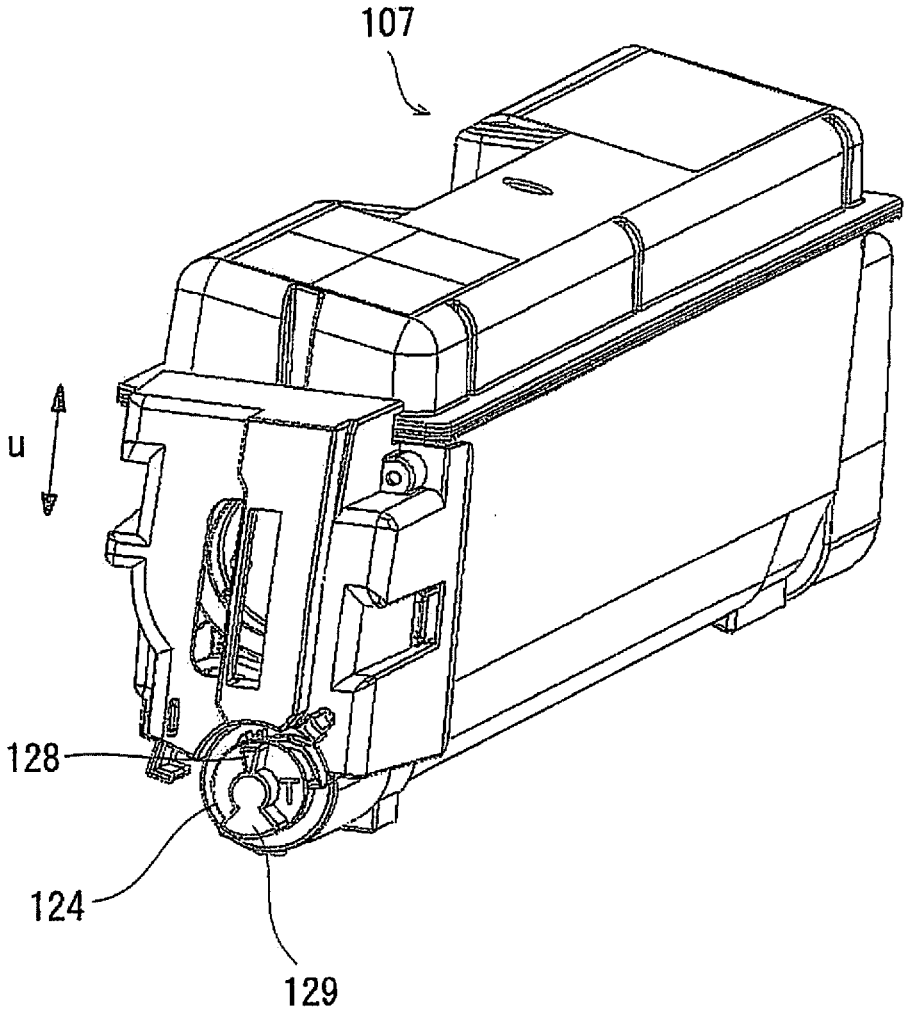
FIG. 10 is a perspective view showing a noncompliant toner supply device with a toner supply opening being in a closed state.

FIG. 10 is a perspective view showing a noncompliant toner supply device with a toner supply opening being in a closed state. In FIG. 10, similar components to those shown in FIGS. 2 to 9 are referred to by the same numerals and descriptions thereof are omitted.

The noncompliant toner supply device 107 has the same configuration as the compliant toner supply device 7M, except for a plurality of fan-shaped connecting parts 128, 129 of a noncompliant open/close coupling joint 124 (a noncompliant open/close joint), as shown in FIG. 10.

In the noncompliant open/close coupling joint 124, the plurality of fan-shaped connecting parts 128, 129 are disposed at an interval of 180 degrees along a circumference of the open/close coupling joint 124, as shown in FIG. 10. The fan-shaped connecting part 128 is positioned upward in the vertical direction u, as shown in FIG. 10. The fan-shaped connecting part 129 is positioned downward. A width of the fan-shaped connecting part 128 is smaller than a width of the fan-shaped connecting part 129 (fan-shaped connecting part 128<fan-shaped connecting part 129).

The widths of the noncompliant fan-shaped connecting parts 128, 129 shown in FIG. 10 are configured upside down compared to that of the compliant fan-shaped connecting parts 28, 29 shown in FIG. 2.

Specific Structure of Open/Close Driving Unit

Next, a specific structure of an open/close driving unit is described with reference to FIGS. 11 to 24.

An open/close driving unit Y switches the toner supply opening 23 of the compliant toner supply devices 7M, 7C, 7Y and 7B shown in FIGS. 2 to 9 between the opened and closed states.

Figure 11:
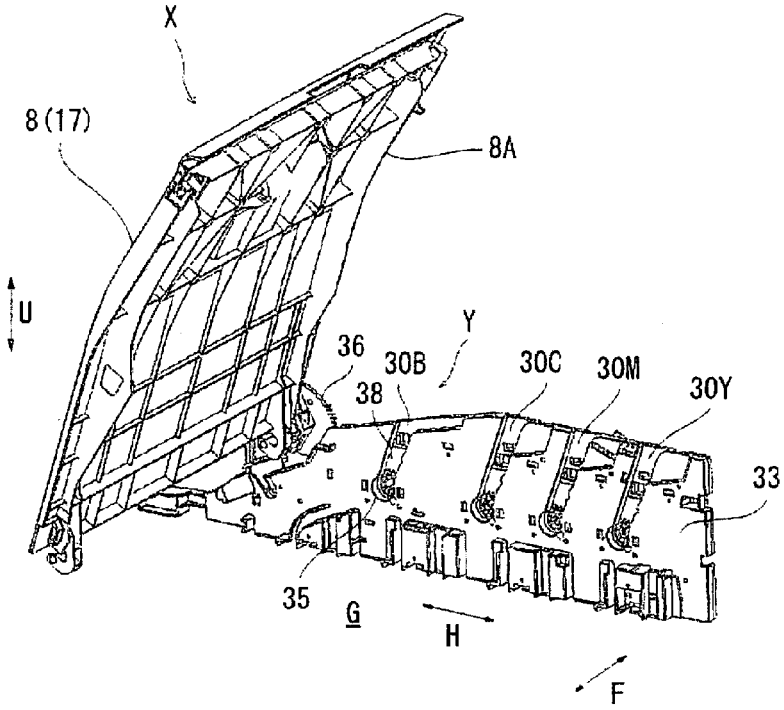
FIG. 11 is a front perspective view showing a state in which a cover door body is fully opened and the installation space is exposed.
Figure 12:
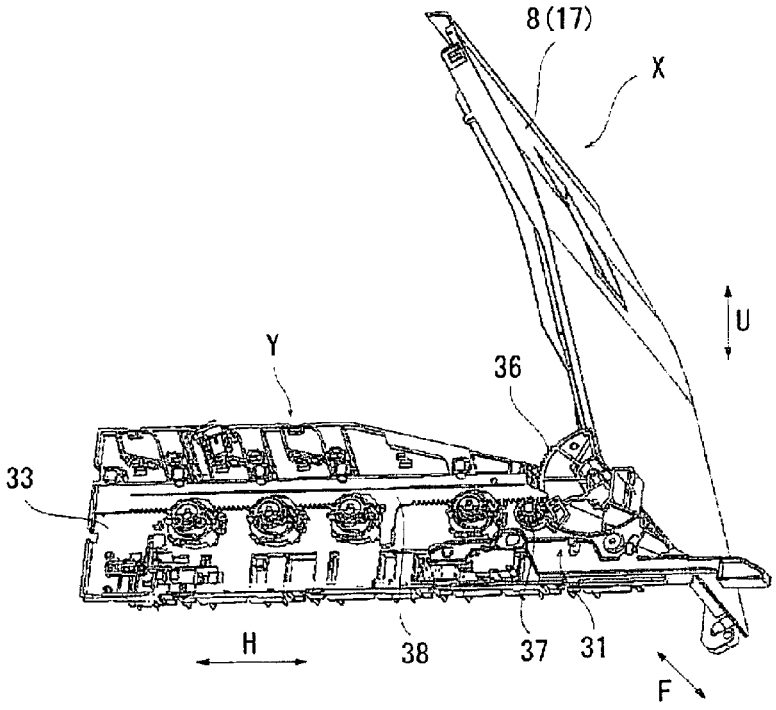
FIG. 12 is a rear perspective view showing a state in which the cover door body is fully opened and the installation space is exposed.
Figure 13:
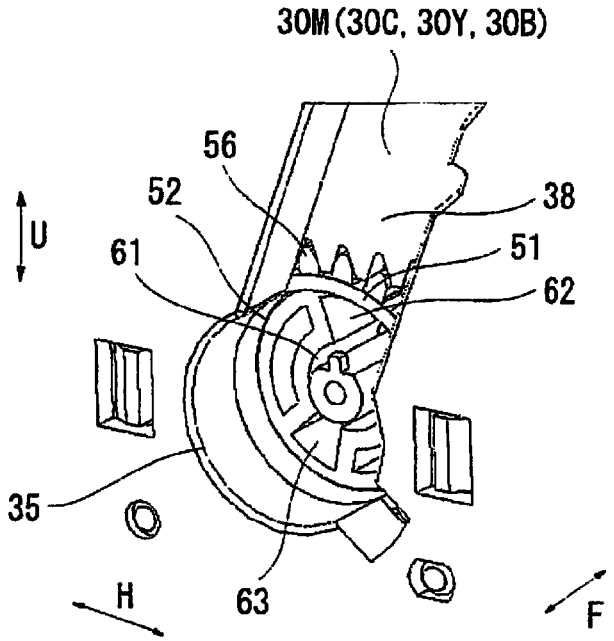
FIG. 13 is a front perspective view showing a state of a driving coupling joint when the cover door body is fully opened.
Figure 14:
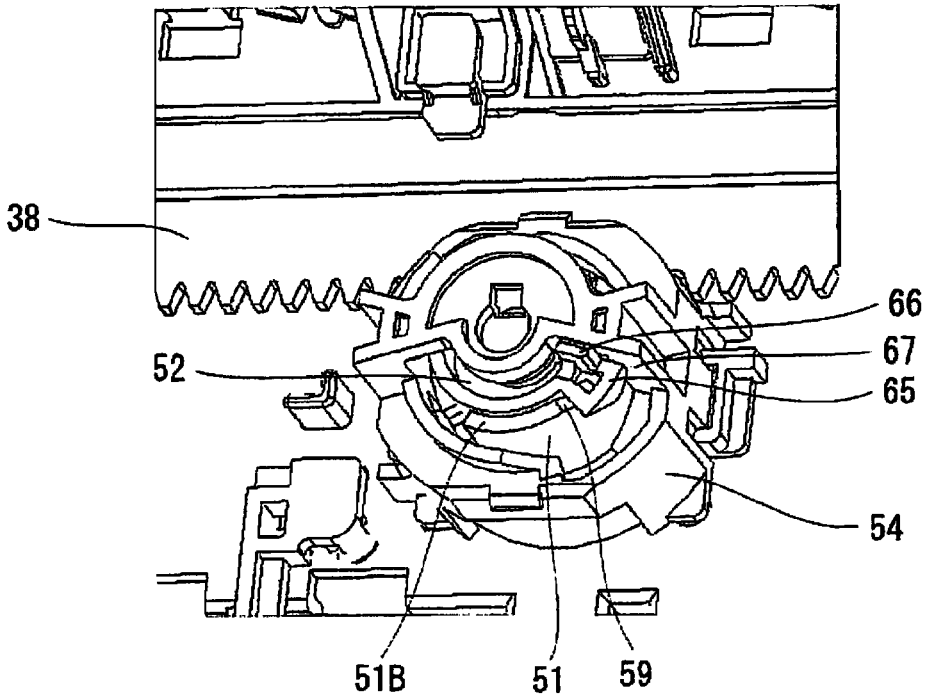
FIG. 14 is a rear perspective view showing a state of the driving coupling joint when the cover door body is fully opened.
Figure 15:
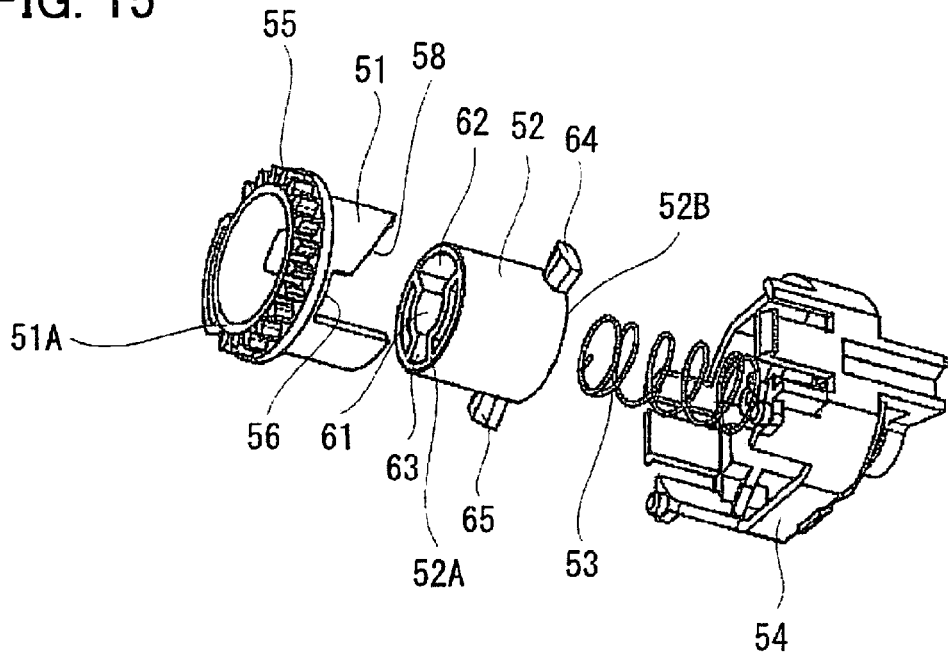
FIG. 15 is a perspective view showing a constitution of the driving coupling joint.
Figure 16:
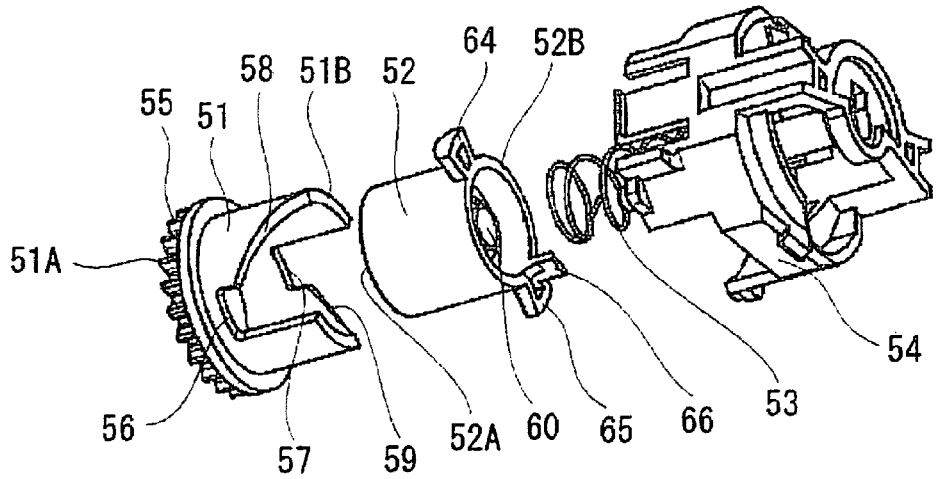
FIG. 16 is a perspective view showing a constitution of the driving coupling joint.
Figure 17:
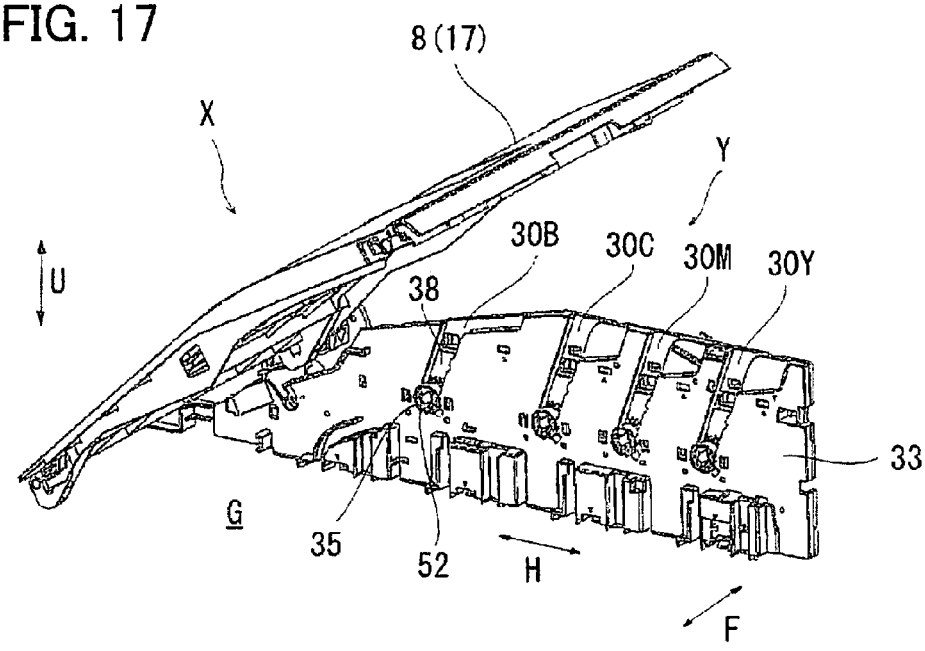
FIG. 17 is a front perspective view showing a state in which a cover door body is half-opened and the installation space is exposed.
Figure 18:
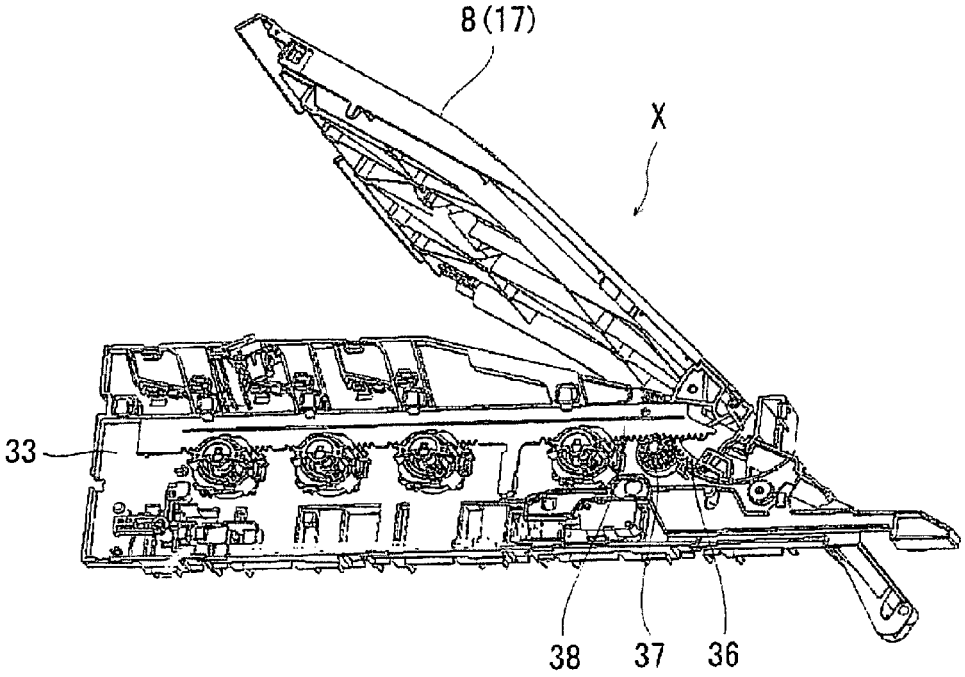
FIG. 18 is a rear perspective view showing a state in which the cover door body is half-opened and the installation space is exposed.
Figure 19:
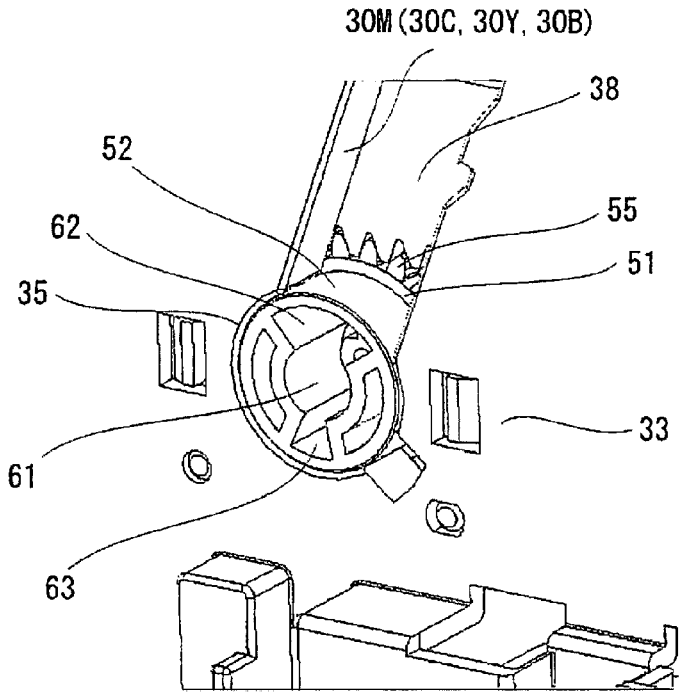
FIG. 19 is a front perspective view showing a state of the driving coupling joint when the cover door body is half-opened.
Figure 20:
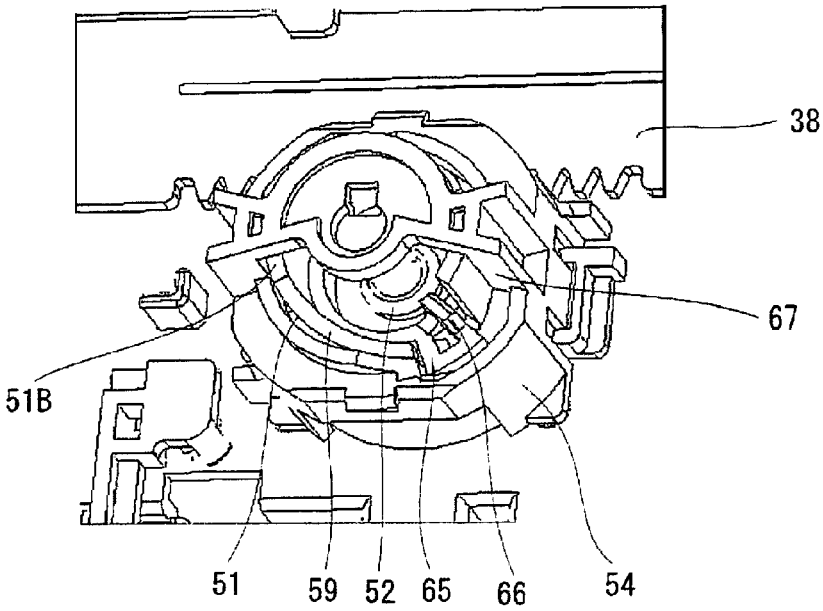
FIG. 20 is a rear perspective view showing a state of the driving coupling joint when the cover door body is half-opened.
Figure 21:
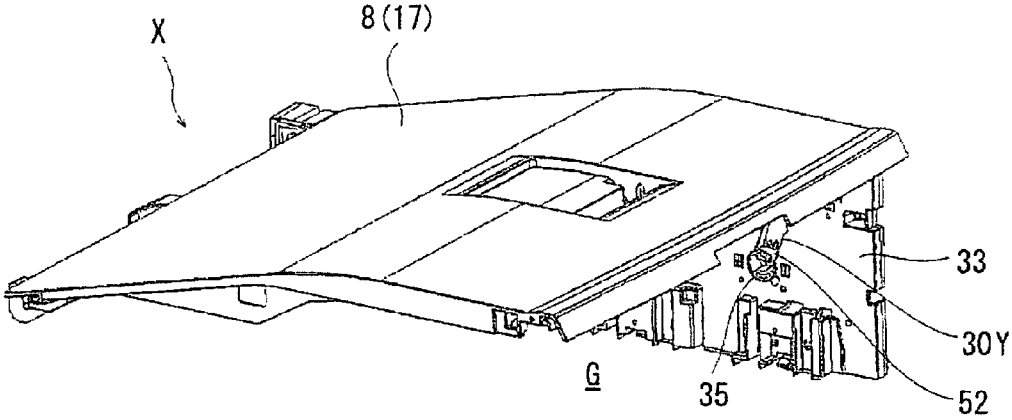
FIG. 21 is a front perspective view showing a state in which the cover door body is closed.
Figure 22:
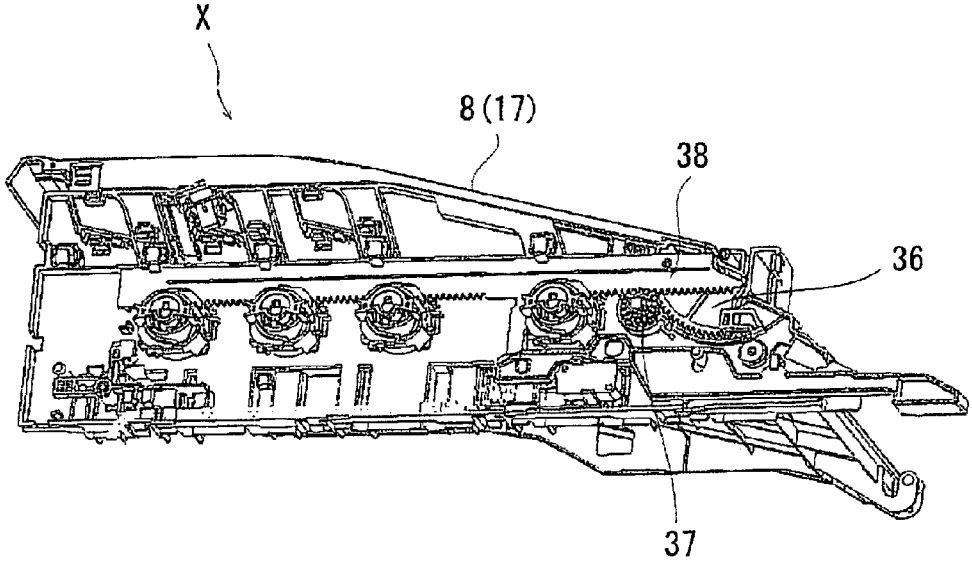
FIG. 22 is a rear perspective view showing a state in which the cover door body is closed.
Figure 23:
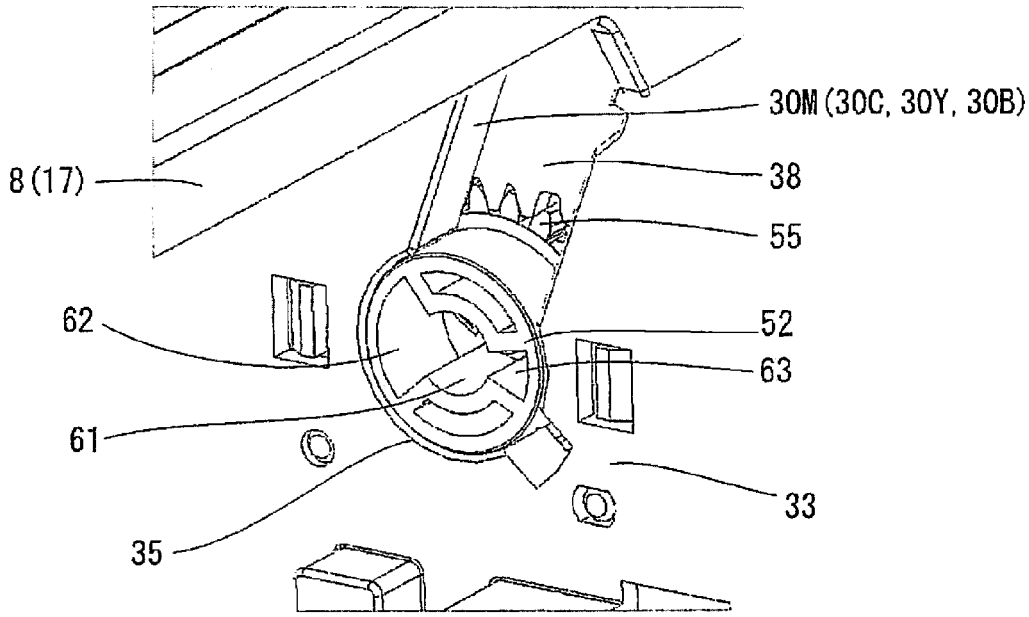
FIG. 23 is a front perspective view showing a state of the driving coupling joint when the cover door body is closed.
Figure 24:
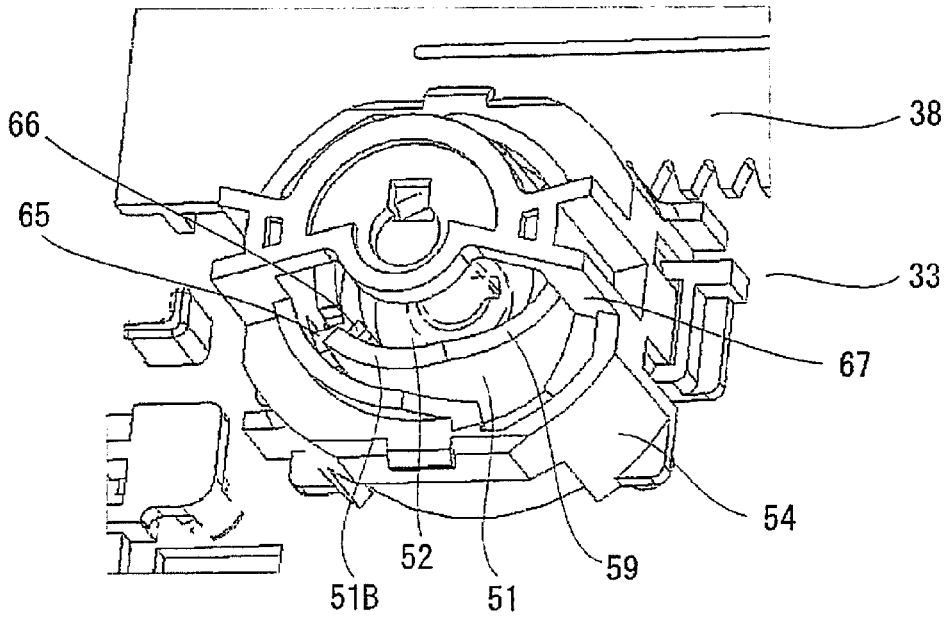
FIG. 24 is a rear perspective view showing a state of the driving coupling joint when the cover door body is closed.

FIG. 11 is a front perspective view showing a state in which a cover door body is fully opened and the installation space is exposed. FIG. 12 is a rear perspective view showing a state in which the cover door body is fully opened and the installation space is exposed. FIG. 13 is a front perspective view showing a state of a driving coupling joint when the cover door body is fully opened. FIG. 14 is a rear perspective view showing a state of the driving coupling joint when the cover door body is fully opened. FIG. 15 is a perspective view showing a constitution of the driving coupling joint. FIG. 16 is a perspective view showing a constitution of the driving coupling joint. FIG. 17 is a front perspective view showing a state in which a cover door body is half-opened and the installation space is exposed. FIG. 18 is a rear perspective view showing a state in which the cover door body is half-opened and the installation space is exposed. FIG. 19 is a front perspective view showing a state of the driving coupling joint when the cover door body is half-opened. FIG. 20 is a rear perspective view showing a state of the driving coupling joint when the cover door body is half-opened. FIG. 21 is a front perspective view showing a state in which the cover door body is closed. FIG. 22 is a rear perspective view showing a state in which the cover door body is closed. FIG. 23 is a front perspective view showing a state of the driving coupling joint when the cover door body is closed. FIG. 24 is a rear perspective view showing a state of the driving coupling joint when the cover door body is closed.

The open/close driving unit Y is composed of: the cover door body 8; a plurality of guide grooves 30M, 30C, 30Y and 30B; a gear transmission structure 31; and a driving coupling joint 32 (driving joint), as shown in FIGS. 11 to 16.

The cover door body 8 is rotatably pivotally supported by both side wall panels 33, 34 (the side wall panel 34 not illustrated), which form the installation space G, of the apparatus main body 1, thereby opening and closing the installation space G, as shown in FIGS. 11 and 12.

The plurality of guide grooves 30M, 30C, 30Y and 30B are formed on the side wall panel 33 of the apparatus main body 1, as shown in FIG. 11. The plurality of guide grooves 30M, 30C, 30Y and 30B are arranged at intervals in the width direction H of the apparatus main body 1. The guide grooves 30M, 30C, 30Y and 30B open toward the opening and the inside of the installation space G and extend downward in the vertical direction U. In addition, in a lower end of each of the guide grooves 30M, 30C, 30Y and 30B, a driving receiver hole 35 is formed, as shown in FIGS. 11 and 13. The driving receiver hole 35 penetrates the side wall panel 33 in a depth direction F of the apparatus main body 1.

The gear transmission structure 31 is disposed on a reverse side of the side wall panel 33, as shown in FIGS. 12 and 14. The gear transmission structure 31 is provided with a fan-shaped gear 36, a pinion gear 37, and a rack gear 38.

The fan-shaped gear 36 is positioned in a first end 8A in the depth direction F of the cover door body 8, as shown in FIGS. 11 and 12. The fan-shaped gear 36 is fixed on a lower side in the vertical direction U of the cover door body 8.

The pinion gear 37 is rotatably supported on the side wall panel 33 so as to engage with the fan-shaped gear 36, as shown in FIG. 12.

The rack gear 38 is disposed on the side wall panel 33 so as to engage with the pinion gear 37 and to be movable in the width direction H, as shown in FIGS. 12 and 14. The rack gear 38 is positioned above the driving receiver hole 35 of each of the guide grooves 30M, 30C, 30Y and 30B, as shown in FIGS. 12 and 13. The rack gear 38 extends in the width direction H.

In the gear transmission structure 31 thus configured, the fan-shaped gear 36 and the pinion gear 37 rotate along with opening and closing of the cover door body 8, thereby moving the rack gear 38 in the width direction H.

The driving coupling joint 32 is provided with a cylindrical gear body 51, a cylindrical rotator 52, a coil spring 53 (biasing member) and a holder case body 54, as shown in FIGS. 15 and 16.

On a first end 51A of the cylindrical gear body 51, a gear 55 is formed on an outer periphery thereof, as shown in FIGS. 15 and 16. In addition, on a second end 51B of the cylindrical gear body 51, two restriction grooves 56, 57 and two cam faces 58, 59 are formed, as shown in FIGS. 15 and 16. The restriction grooves 56, 57 are disposed at an interval of 180 degrees along a circumference of the cylindrical gear body 51, as shown in FIG. 16. The restriction grooves 56, 57 open toward the second end 51B and extend to the vicinity of the gear 55. The cam faces 58, 59 are disposed at an interval of 180 degrees along a circumference of the cylindrical gear body 51, as shown in FIGS. 15 and 16. The cam face 58 inclines from the second end 51B of the cylindrical gear body 51 to the gear 55 on the outer periphery, and reaches the restriction groove 56. In addition, the cam face 59 inclines from the second end 51B of the cylindrical gear body 51 to the gear 55 on the outer periphery, and reaches the restriction groove 57, as shown in FIG. 16.

The cylindrical rotator 52 is provided with a connected hole body 60 and a plurality of cam projections 64, 65, as shown in FIG. 15.

The cylindrical rotator 52 is provided with a connected hole body 60 and a plurality of cam projections 64, 65, as shown in FIG. 15. The connected hole body 60 opens in a first end 52A of the rotator 52 and extends to a second end 52B, as shown in FIG. 15. The connected hole body 60 is composed of a round hole 61 and two fan-shaped holes 62, 63. The round hole 61 is formed along an axial center of the rotator 52. The two fan-shaped holes 62, 63 are formed at an interval of 180 degrees along a circumference of the round hole 61. The fan-shaped holes 62, 63 are communicatively connected to the round hole 61 and have shapes that broaden as approaching an outer periphery of the rotator 52, as shown in FIG. 15. The fan-shaped hole 62 is positioned upward in the vertical direction u, as shown in FIG. 15. The fan-shaped hole 63 is positioned downward. A width of the fan-shaped hole 62 is larger than a width of the fan-shaped hole 63 (fan-shaped hole 62>fan-shaped hole 63). The compliant fan-shaped connecting parts 28, 29 shown in FIG. 2 are inserted into the fan-shaped holes 62, 63 respectively.

The two cam projections 64, 65 are disposed on the second end 52B of the rotator 52, as shown in FIGS. 15 and 16. The two cam projections 64, 65 project in a circumferential direction of the rotator 52. The two cam projections 64, 65 are arranged to correspond to the fan-shaped holes 62, 63, respectively, as shown in FIG. 15. In addition, in the vicinity of the cam projection 65, a detection projection 66 that projects from the second end 52B in an axial direction is disposed. The cam projections 64, 65 have mound shapes on a side facing the cylindrical gear body 51, when viewed from a projecting direction.

The coil spring 53 is disposed between the second end 52B of the rotator 52 and a holder case body 54, as shown in FIGS. 15 and 16.

The driving coupling joint 32 thus configured is disposed on a reverse side of the side wall panel 33, as shown in FIGS. 11 to 14. The driving coupling joint 32 is loaded in a state of facing the driving receiver hole 35 of each of the guide grooves 30M, 30C, 30Y and 30B.

In addition, as shown in FIGS. 11 to 14, in a state in which the cover door body 8 is opened, the cylindrical gear body 51, the rotator 52, the coil spring 53 and the holder case body 54 of the driving coupling joint 32 are loaded as follows.

The cylindrical gear body 51 is positioned to face the driving receiver hole 35 of each of the guide grooves 30M, 30C, 30Y and 30B from the reverse side of the side wall panel 33, as shown in FIGS. 11 and 13.

The first end 51A of the cylindrical gear body 51 contacts the side wall panel 33. The gear 55 engages with the rack gear 38, as shown in FIGS. 11 and 13.

The rotator 52 is inserted into the cylindrical gear body 51 from the first end 52A, as shown in FIGS. 11 and 13. The cam projections 64, 65 contact the second end 51B of the cylindrical gear body 51, as shown in FIGS. 15 and 16.

The coil spring 53 is disposed inside the second end 52B of the rotator 52 and inside the holder case body 54, as shown in FIGS. 15 and 16.

Inside the holder case body 54, the cylindrical gear body 51, the rotator 52, and the coil spring 53 are disposed in this order from the second end 51A side, as shown in FIGS. 14 to 16. The holder case body 54 is attached to the side wall panel 33.

As a result, the driving coupling joint 32 is in an initial state in which the rotator 52 is disposed inside the cylindrical gear body 51 with the cover door body 8 being opened, as shown in FIGS. 11 to 14. Here, the cam projection 65 contacts a restriction wall 67 formed on the holder case body 54, as shown in FIG. 14. In addition, the cam projections 64, 65 of the rotator 52 contact the cam faces 58, 59 respectively, in the vicinities of ends thereof, near the second end 51B of the cylindrical gear body 51. The rotator 52 is thus positioned in a state of being biased by a biasing force of the coil spring 53 toward the driving receiver hole 35 and the restriction wall 67.

The fan-shaped holes 62, 63 of the rotator 52 face the driving receiver hole 35, as shown in FIG. 13.

When the open/close driving unit Y is closing the cover door body 8 from the opened state as shown in FIGS. 11 to 14, the rack gear 38 moves to the right as shown in FIG. 18 in a state in which the cover door body 8 is half closed as shown in FIGS. 17 and 18.

As a result, the cylindrical gear body 51 that engages with the rack gear 38 is in a state of being rotated in a clockwise direction, as shown in FIG. 18. The cam projections 64, 65 of the rotator 52 slide on the cam faces 58, 59 of the cylindrical gear body 51, as shown in FIG. 20.

And then, the rotator 52 is moved by the biasing force of the coil spring 53, inward from the driving receiver hole 35 along a positioning wall 67 as shown in FIG. 19, and the cam projections 64, 65 reach and engage with the restriction grooves 56, 57. In addition, the fan-shaped holes 62, 63 engage with the fan-shaped connecting parts 28, 29 of the open/close coupling joint 24 of the toner supply devices 7M, 7C, 7Y and 7B.

As shown in FIGS. 21 and 22, when the installation space G is switched to the closed state by the cover door body 8, the rotator 52 rotates as the cam projections 64, 65 engage with the restriction grooves 56, 57, thereby rotating the open/close member 22 of each of the toner supply devices 7M, 7C, 7Y and 7B via the open/close coupling joint 24. In addition, as shown in FIGS. 6 to 9, the toner ejection opening 27 faces the toner supply opening 23.

On the contrary, when the cover door body 8 is being switched from the closed state shown in FIGS. 21 and 22 to the opened state shown in FIGS. 11 and 12, from the closed state to a half-open state, the rotator 52 rotates as the restriction grooves 56, 57 of the cylindrical gear body 51 engage with the cam projections 64, 65 of the rotator 52, thereby rotating the open/close member 22 of each of the toner supply devices 7M, 7C, 7Y and 7B via the open/close coupling joint 24. In addition, as shown in FIGS. 2 to 5, the toner ejection opening 27 does not face the toner supply opening 23. Furthermore, from the half-open state to the opened state of the cover door body 8, rotation of the rotator 52 is restricted as the cam projection 65 thereof contacts the restriction wall of the holder case body 54. Since the cam projections 64, 65 have mound shapes on a side facing the restriction grooves 56, 57, as the cylindrical gear body 51 rotates, the cam projections 64, 65 move in an axial direction against a biasing force of the coil spring 53 and reach the cam faces 58, 59 respectively. And then, the cam projections 64, 65 slide on the cam faces 58, 59 and move along the restriction wall 67 in a direction away from the driving receiver hole 35. Accordingly, the fan-shaped connecting parts 28, 29 of the open/close coupling joint 24 of the toner supply devices 7M, 7C, 7Y and 7B are disengaged from the fan-shaped holes 62, 63. Thereafter, the rotator 52 of each open/close driving unit Y returns to the initial state shown in FIG. 13, in which the rotator is inserted into the cylindrical gear body 51.

Specific Structure of Detection Unit and Notification Unit

Next, a specific structure of a detection unit 71 and a notification unit 81 is described with reference to FIGS. 25 to 28.

Figure 25:
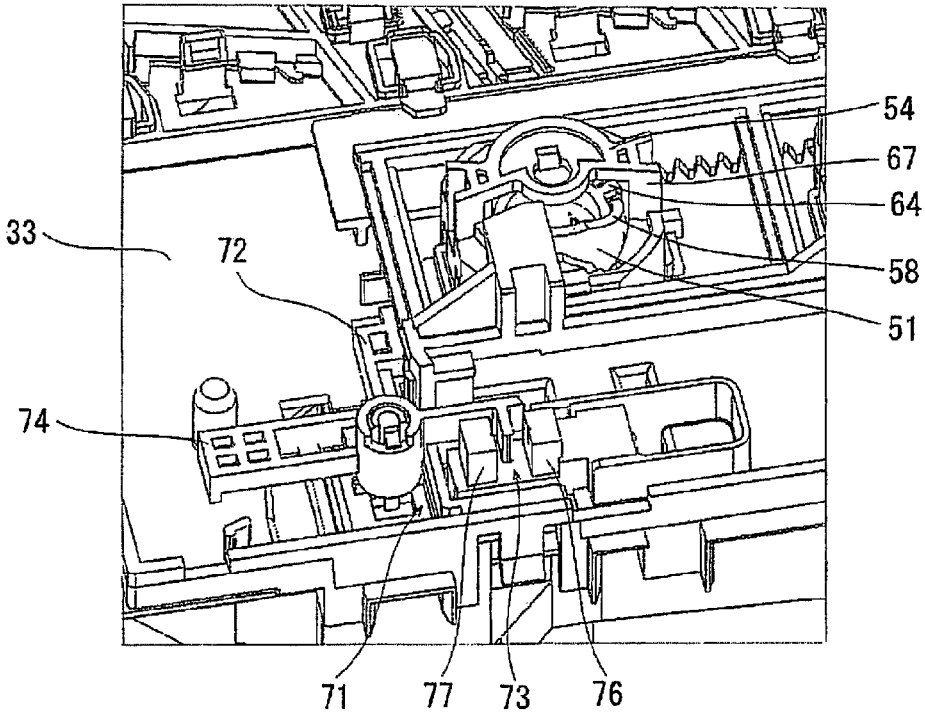
FIG. 25 is a rear perspective view showing a constitution of a detection unit, with a detection subject shielding detection light.
Figure 26:
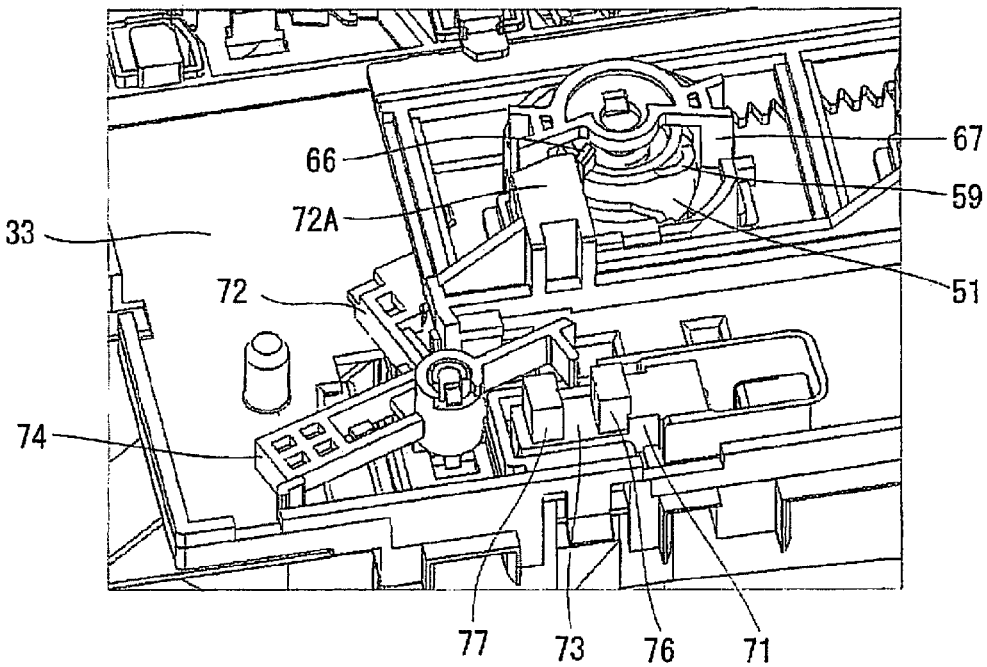
FIG. 26 is a rear perspective view showing a constitution of the detection unit, with a detection subject not shielding the detection light.
Figure 27:
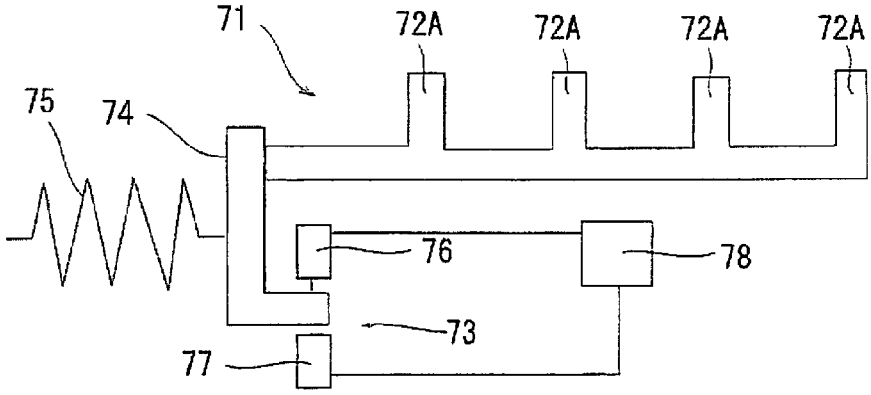
FIG. 27 is a schematic view showing a relationship between the detection unit, a control device and a notification unit, with the detection subject of the detection unit shielding the detection light.
Figure 28:
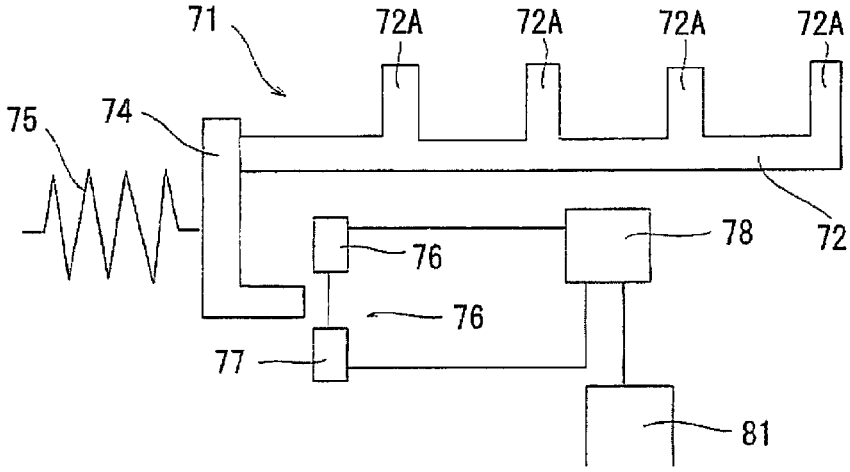
FIG. 28 is a schematic view showing a relationship between the detection unit, the control device and the notification unit, with the detection subject of the detection unit not shielding the detection light.

FIG. 25 is a rear perspective view showing a constitution of a detection unit, with a detection subject shielding detection light. FIG. 26 is a rear perspective view showing a constitution of the detection unit, with a detection subject not shielding the detection light. FIG. 27 is a schematic view showing a relationship between the detection unit, a control device and a notification unit, with the detection subject of the detection unit shielding the detection light. FIG. 28 is a schematic view showing a relationship between the detection unit, the control device and the notification unit, with the detection subject of the detection unit not shielding the detection light.

The detection unit 71 detects compatibility of the toner supply devices 7M, 7C, 7Y, 7B and 107 loaded into the installation space G. The detection unit 71 also detects improper loading (not fully inserted to a loading position) of the compliant toner supply devices 7M, 7C, 7Y and 7B.

The notification unit 81 notifies loading of the noncompliant toner supply device 107 or improper loading of the compliant toner supply devices 7M, 7C, 7Y and 7B to the inside of the installation space G.

The detection unit 71 is disposed on a reverse side of the side wall panel 33, as shown in FIGS. 25 and 26. The detection unit 71 is provided with a detection moving member 72, a detector 73, a detection object member 74, a spring member 75 (biasing member), as shown in FIGS. 25 to 28.

The detection moving member 72 is movably provided to extend in the width direction H of the apparatus main body 1 as shown in FIGS. 25 to 28. The detection moving member 72 has a plurality of moving projections 72A, as shown in FIGS. 27 and 28. The detection projection 66 of each open/close driving unit Y contacts each moving projection 72A.

The detector 73 is composed of a light emitting part 76 that emits detection light and a light receiving part 77 that receives the detection light, as shown in FIGS. 25 to 28. The detector 73 is connected to a control device 78 in the apparatus main body 1.

The detection object member 74 is disposed between the light emitting part 76 and the light receiving part 77 of the detector 73, in a state in which the cover door body 8 is opened, as shown in FIGS. 11 and 12. The detection object member 74 shields the detection light emitted from the light emitting part 76 of the detector 73.

The spring member 75 biases the detection object member 74 toward the detector 73 by a biasing force, as shown in FIGS. 27 and 28.

The notification unit 81 is connected to the control device 78, as shown in FIGS. 27 and 28. The notification unit 81 is composed of a display, a speaker and the like. The notification unit 81 is disposed in the apparatus main body 1 shown in FIG. 1. The notification unit 81 makes notification by display and sound.

The control device 78 determines the toner supply devices 7M, 7C, 7Y, 7B and 107 loaded into the installation space G or improper loading of the compliant toner supply devices 7M, 7C, 7Y and 7B, based on a result of detection (ON/OFF of the detection light) by the detection unit 71, as shown in FIGS. 27 and 28. Furthermore, the control device 78 outputs a notification instruction to the notification unit 81, based on a result of determination.

Loading Procedure of Toner Supply Device

An application procedure of the compliant toner supply devices 7M, 7C, 7Y and 7B and an application procedure of the noncompliant toner supply device 107 are described hereinafter with reference to FIGS. 1 to 29.

Figure 29:
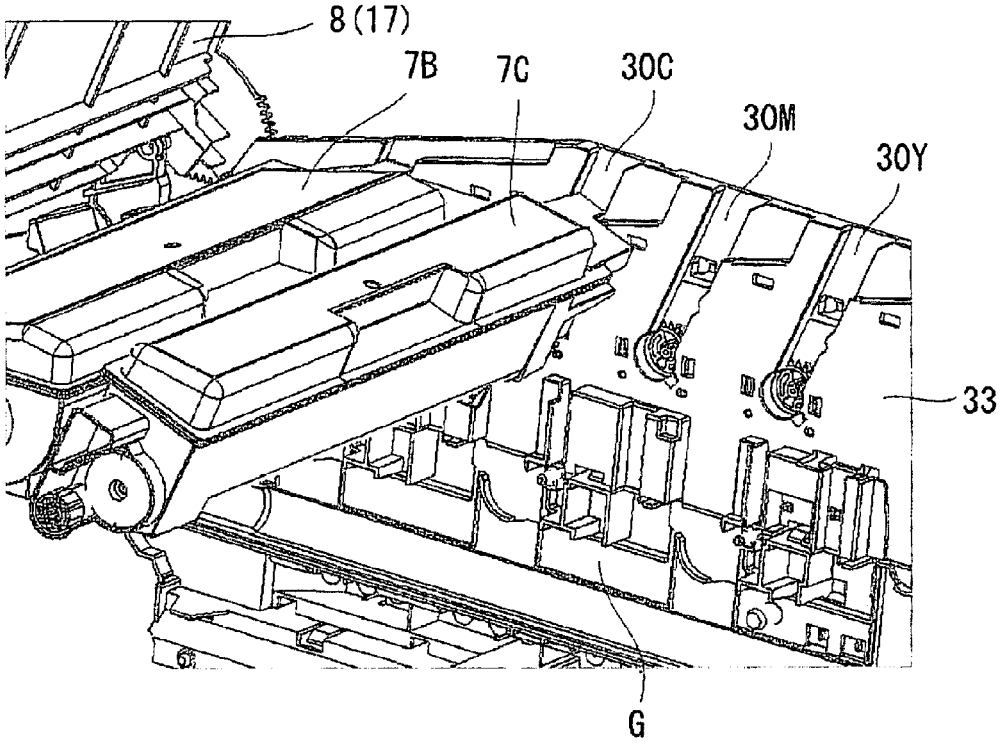
FIG. 29 is a perspective view showing a state in which the toner supply device is loaded into the installation space.

FIG. 29 is a perspective view showing a state in which the toner supply device is loaded into the installation space. For the sake of illustration, the cover door body 8 is in the opened state as shown in FIGS. 11 and 12, thereby exposing the opening of the installation space G. Accordingly, the open/close driving unit Y is in the initial state, as shown in FIGS. 13 and 14.

In addition, the cam projection 64 of the rotator 52 contacts the second end 51A of the cylindrical gear body 51 as shown in FIG. 26, and pushes the detection moving member 72 toward the detection object member 74 as shown in FIG. 28. The detection moving member 72 thus moves the detection object member 74 away from the detector 73, against the biasing force of the spring member 75.

1. Loading Procedure of Compliant Toner Supply Devices 7M, 7C, 7Y, 7B An engineer loads the compliant toner supply devices 7M, 7C, 7Y and 7B of magenta, cyan, yellow and black into the installation space G.

Upon loading the toner supply devices 7M, 7C, 7Y and 7B into the installation space G, the compatible open/close coupling joint 24 is inserted respectively into the guide grooves 30M, 30C, 30Y and 30B shown in FIG. 11, as shown in FIG. 2. Subsequently, each of the toner supply devices 7M, 7C, 7Y and 7B is moved into the installation space G, as shown in FIG. 29.

Each of the toner supply devices 7M, 7C, 7Y and 7B is inserted to such a position that the compatible open/close coupling joint 24 faces the rotator 52 of the driving coupling joint 32, as shown in FIGS. 11 and 13.

As a result, the fan-shaped connecting parts 28, 29 of the compatible open/close coupling joint 24 face the fan-shaped holes 62, 63 of the rotator 52 shown in FIG. 13.

An engineer loads the compliant toner supply devices 7M, 7C, 7Y and 7B into the installation space G and closes the cover door body 8. When the cover door body 8 is closed, the cylindrical gear body 51 of the driving coupling joint 32 is rotated by the fan-shaped gear 36, the pinion gear 37, and the rack gear 38 of the gear transmission structure 31, as shown in FIGS. 11, 18 and 22. As the cylindrical gear body 51 rotates, the cam projections 64, 65 of the rotator 52 slide respectively on the cam faces 58, 59 of the cylindrical gear body 51, as shown in FIGS. 14, 20 and 24. The rotator 52 is thus rotationally moved toward the driving receiver hole 35.

Accordingly, the fan-shaped connecting parts 28, 29 of the compliant toner supply devices 7M, 7C, 7Y and 7B are fitted into the fan-shaped holes 62, 63 of the rotator 52, respectively. The compatible open/close coupling joint 24 is connected to the driving coupling joint 32.

As the compatible open/close coupling joint 24 is connected thereto, the driving coupling joint 32 rotates (moves) the compatible open/close coupling joint 24. The open/close member 22 is thus also rotated (moved).

As the open/close member 22 rotates, the toner ejection opening 27 is communicatively connected to the toner supply opening 23, as shown in FIGS. 7 to 9. And then, by rotationally driving the screw conveyor 25 of each of the toner supply devices 7M, 7C, 7Y and 7B, the toner of each color is fed from the toner supply opening 23 to each of the image forming units 2M, 2C, 2Y and 2B shown in FIG. 1 through the toner ejection opening 27.

The screw conveyor 25 is driven as a driving transmission means (not illustrated), provided on the second end 25B side, and is engaged with a driving means in the apparatus main body.

In accordance with a closing movement of the cover door body 8, the cam projections 64, 65 of the rotator 52 slide respectively on the cam faces 58, 59, as shown in FIGS. 14, 20 and 24. As a result, the detection projection 66 is moved away from the detection moving member 72, as shown in FIGS. 25 and 27.

The detection object member 74 is thus maintained in a state of being biased by the biasing force of the spring member 75, as shown in FIG. 27. The detection object member 74 is inserted between the light emitting part 76 and the light receiving part 77 of the detector 73, thereby shielding the detection light emitted from the light emitting part 76 of the detector 73.

The control device 78 determines that the compliant toner supply devices 7M, 7C, 7Y and 7B are loaded into the installation space G in a case in which the detection light of the detector 73 is shielded when the installation space G is in the closed state by the cover door body 8, as shown in FIG. 27. In this case, the notification unit 81 does not make notification.

Loading Procedure of Noncompliant Toner Supply Device

An engineer loads the noncompliant toner supply device 107 into the installation space G in a state in which the cover door body 8 is opened, as shown in FIGS. 11 and 12.

Upon loading the toner supply device 107 into the installation space G, the noncompliant open/close coupling joint 124 is inserted respectively into the guide grooves 30M, 30C, 30Y and 30B shown in FIG. 11, as shown in FIG. 10. Subsequently, the toner supply device 107 is moved into the installation space G, as shown in FIG. 29.

The toner supply device 107 is inserted to such a position that the noncompliant open/close coupling joint 124 faces the rotator 52 of the open/close driving unit Y, as shown in FIGS. 11 and 13.

As a result, the fan-shaped connecting parts 128, 129 of the noncompliant open/close coupling joint 124 face the fan-shaped holes 62, 63 of the rotator 52 shown in FIG. 13.

When the engineer has loaded the noncompliant toner supply device 107 to the installation space G and closed the cover door body 8, the cylindrical gear body 51 of the driving coupling joint 32 is rotated by the gears 36, 37, 38 of the gear transmission structure 31, as shown in FIGS. 11, 18 and 22.

Here, the fan-shaped holes 62, 63 of the rotator 52 and the noncompliant fan-shaped connection parts 128, 129 have mismatched shapes. Accordingly, the fan-shaped connection parts 128, 129 cannot be inserted into the fan-shaped holes 62, 63.

The driving coupling joint 32 and the noncompliant open/close coupling joint 124 are thus in a non-connected state (not connected to each other), thereby restricting movement of the rotator 52 toward the driving receiver hole 35. Unless the rotator 52 moves toward the driving receiver hole 35, the detection projection 66 is maintained to project toward the detection moving member 72. The detection projection 66 rotates in contact with the moving projection 72A of the detection moving member 72, thereby moving the detection moving member 72 against the biasing force of the spring member 75, as shown in FIGS. 26. The detection object member 74 is thus rotationally ejected from the detector 73, without shielding the detection light emitted from the light emitting part 76 of the detector 73, as shown in FIGS. 26 and 28.

Unless the rotator 52 rotates, the cam projections 64, 65 are maintained to contact the second end 51B of the cylindrical gear body 51.

The cam projections 64, 65 contact the moving projections 72A of the detection moving member 72, as shown in FIG. 26. The detection object member 74 thus does not shield the detection light emitted from the light emitting part 76 of the detector 73, as shown in FIGS. 26 and 28.

The control device 78 determines that the noncompliant toner supply device 107 is loaded into the installation space G in a case in which the detection light of the detector 73 is not shielded when the installation space G is in the closed state by the cover door body 8, as shown in FIG. 28.

As a result, the control device 78 outputs the notification instruction to the notification unit 81, as shown in FIG. 28. In response to the notification instruction thus inputted, the notification unit 81 notifies loading of the noncompliant toner supply device 107 on the display and by sound.

The engineer opens the cover door body 8, removes the noncompliant toner supply device 107 from the installation space G, and loads the compliant toner supply devices 7M, 7C, 7Y and 7B into the installation space G.

Improper Loading of Compliant Toner Supply Device

Upon loading the compliant toner supply devices 7M, 7C, 7Y and 7B into the installation space G, the driving coupling joint 32 and the compatible open/close coupling joint 24 are in the non-connected state if the open/close coupling joint 24 is not fully inserted into the guide grooves 30M, 30C, 30Y and 30B.

In such a state, the movement of the rotator 52 of the driving coupling joint 32 toward the driving receiver hole 35 is restricted as in a case of loading of the noncompliant toner supply device 107. The detection projection 66 thus rotates in contact with the moving projection 72A of the detection moving member 72, as shown in FIGS. 26 and 28.

The detection object member 74 thus does not shield the detection light of the detector 73, as shown in FIGS. 26 and 28.

The control device 78 determines that the toner supply devices 7M, 7C, 7Y and 7B are improperly loaded into the installation space G in a case in which the detection light of the detector 73 is not shielded when the installation space G is in the closed state by the cover door body 8, as shown in FIG. 28.

As a result, the control device 78 outputs the notification instruction to the notification unit 81, as shown in FIG. 28. In response to the notification instruction thus inputted, the notification unit 81 notifies the improper loading of the toner supply devices 7M, 7C, 7Y and 7B on the display and by sound.

The engineer opens the cover door body 8, removes the toner supply devices 7M, 7C, 7Y and 7B improperly loaded from the installation space G, and reloads the toner supply devices 7M, 7C, 7Y and 7B into the installation space G.

As an application of the detection of improper loading, a so-called noncompliant configuration, which does not allow full insertion unless shapes conform to each other, can be employed by making shapes partially different between the cartridge container 21 and the installation space G in the vicinity of an end thereof, where the open/close coupling joint 24 of the toner supply devices 7M, 7C, 7Y and 7B is provided. Such a configuration allows detection and discrimination of toner supply devices of a greater variation, by combination of the shapes of the open/close coupling joint 24 and the shapes of the cartridge container 21. As an example of the noncompliant configuration, a configuration can be employed in which the cover door body 8 cannot be completely closed in a case in which a noncompliant toner supply device is loaded. However, since the cover door body 8 is a relatively large member, false detection is likely due to variation of size in production and deformation by deflection. In addition, there is a possibility of breakage due to forced closing of the cover door body 8. The configuration of detecting incompatibility by detecting improper loading of the present invention can provide a reliable detection with only a small change in shape, without a risk of breakage of the apparatus and the like.

As described above, the image forming apparatus X of the present invention detects types of the toner supply devices 7M, 7C, 7Y, 7B and 107 (compatible or noncompliant) by detecting a rotated position of the rotator 52 of the driving coupling joint 32 by the detection unit 71.

In addition, as the rotator 52 is rotated, the toner supply opening 23 of the compliant toner supply devices 7M, 7C, 7Y and 7B is switched to the opened state. On the other hand, if the rotator 52 is not rotated, the toner supply opening 23 of the noncompliant toner supply device 107 or the compliant toner supply devices 7M, 7C, 7Y and 7B being improperly loaded is in the closed state. The detection unit 71 can thus detect open and close of the toner supply opening 23 of the toner supply devices 7M, 7C, 7Y and 7B.

The notification unit 81 can make notification based on the rotated position of the rotator 52 and open and close of the toner supply opening 23.

This can prevent use of the apparatus main body with the noncompliant toner supply device loaded thereinto. In addition, since the apparatus main body does not operate with the toner supply device improperly loaded, leakage of toner and a toner supply defect can be prevented.

In the image forming apparatus X of the present invention, a configuration of detecting a type of each toner supply device loaded into the installation space G or detecting improper loading of a toner supply device can be realized without providing the detection unit 71 to each of the guide grooves 30M, 30C, 30Y and 30B. As a result, even an apparatus with a plurality of image forming units will not have a complex structure, and can be reduced in size and cost.

INDUSTRIAL APPLICABILITY

The present invention can be preferably applied to image forming apparatuses using xerography such as a copy machine, a printer, a facsimile machine and the like, and other printing machines, that form (transfer) an image on printing paper using a toner.

What is claimed is:

1. An image forming apparatus comprising:

at least one image forming unit that is disposed in an apparatus main body and forms a toner image;

at least one toner supply device that is loadable and unloadable with respect to an installation space in the apparatus main body and supplies a toner to the image forming unit, in which the toner supply device includes a toner supply opening that is communicatively connected to the image forming unit and an open/close member that opens and closes the toner supply opening;

a detection unit that detects, regarding the toner supply device loaded into the installation space, a type of the toner supply device or detects improper loading of the toner supply device; and a notification unit that notifies loading of the toner supply device of a wrong type or improper loading of the toner supply device based on a result of detection by the detection unit, wherein the toner supply device comprises an open/close joint that operates the open/close member to open and close;

the open/close joint has different shapes according to the type of the toner supply device;

the apparatus main body comprises a driving joint that has a shape that can or cannot be connected to the open/close joint according to a shape of the open/close joint after loading the toner supply device to the installation space, the driving joint switching the open/close member of the toner supply device to an opened state by driving the open/close joint when connected; and the detection unit detects the type of the toner supply device based on an opened or closed state of the toner supply opening of the toner supply device.

2. The image forming apparatus according to claim 1, wherein the driving joint is not connected to the open/close joint in a case in which the toner supply device of a correct type is improperly loaded into the installation space, and the detection unit detects improper loading of the toner supply device based on a closed state of the toner supply opening.

3. The image forming apparatus according to claim 1, wherein the driving joint comprises a rotator that has a shape that can or cannot be connected to the open/close joint according to the shape of the open/close joint after loading the toner supply device to the installation space, the rotator rotating upon connection with the open/close joint, and the detection unit detects the type of the toner supply device based on a position of the rotator.

4. The image forming apparatus according to claim 3, wherein the rotator is not connected to the open/close joint in a case in which the toner supply device of a correct type is improperly loaded into the installation space, and the detection unit detects improper loading of the toner supply device based on a position of the rotator.

5. The image forming apparatus according to claim 1, wherein the apparatus main body comprises a cover door body that opens and closes an opening of the installation space, the cover door body opening and closing the opening of the installation space in a state in which the toner supply device is loaded into the installation space.

* * * * *